US007059930B2

(12) United States Patent
Choi

(10) Patent No.: US 7,059,930 B2
(45) Date of Patent: Jun. 13, 2006

(54) TOY FOR PRODUCING BUBBLES

(75) Inventor: Kei Fung Choi, Causeway Bay (HK)

(73) Assignee: Silverlit Toys Manufactory, Ltd., Hong Kong (CN)

( * ) Notice: Subject to any disclaimer, the term of this patent is extended or adjusted under 35 U.S.C. 154(b) by 334 days.

(21) Appl. No.: 10/703,914

(22) Filed: Nov. 7, 2003

(65) Prior Publication Data

US 2004/0142626 A1 Jul. 22, 2004

Related U.S. Application Data

(60) Provisional application No. 60/424,781, filed on Nov. 7, 2002.

(51) Int. Cl.
*A63H 33/28* (2006.01)

(52) U.S. Cl. ..... 446/15; 446/178

(58) Field of Classification Search ..... 446/15–21, 446/176, 178, 475, 483
See application file for complete search history.

(56) References Cited

U.S. PATENT DOCUMENTS

| | | | | |
|---|---|---|---|---|
| 2,393,039 | A | 1/1946 | Gilchrist, Jr. | |
| 2,675,641 | A | 4/1954 | Baggott | |
| 2,974,438 | A | 3/1961 | Hopkins | |
| 2,989,818 | A | 6/1961 | Filger et al. | |
| 3,775,899 | A | 12/1973 | Wolf | |
| 3,814,394 | A | 6/1974 | Murray | |
| 4,334,383 | A * | 6/1982 | Melotti | 446/15 |
| 4,423,565 | A | 1/1984 | Bart | |
| 5,224,892 | A | 7/1993 | Messina | |
| 5,224,893 | A | 7/1993 | Routzong et al. | |
| 5,366,402 | A | 11/1994 | Rudell et al. | |
| 5,498,191 | A | 3/1996 | DeMars | |
| 5,613,890 | A | 3/1997 | DeMars | |

FOREIGN PATENT DOCUMENTS

| | | |
|---|---|---|
| JP | 5-285278 | 11/1993 |

* cited by examiner

*Primary Examiner*—Kien Nguyen
(74) *Attorney, Agent, or Firm*—Greenberg Traurig, LLP

(57) ABSTRACT

A bubble making toy includes a propeller to cause liquid from an outlet port to spread across the space formed in a ring downstream of the propeller. The air generated by the propeller rotates under the action of a fan upstream of the propeller, and causes the ejection of air bubbles from the toy. The bubbles are formed by liquid which is pumped from a reservoir to a dispensing port above the circumferential ring. There is a second reservoir connected to an outlet and operable by finger action to effect the ejection of fluid such as water from a second orifice from the toy. The freely rotating propeller is mounted in the air path from the housing to the outlet for the bubbles and assists in spreading liquid across the space defined by the circumferential ring onto which liquid flows from the outlet port.

13 Claims, 2 Drawing Sheets

TOY FOR PRODUCING BUBBLES

RELATED APPLICATIONS

This application is related to provisional application No. 60/424,781, filed Nov. 7, 2002, the contents of which are incorporated herein in their entirety.

BACKGROUND OF THE INVENTION

1. Field of the Invention

This invention relates to toys. In particularly it concerns a toy for forming and expelling bubbles in the nature of soap bubbles under the action of air propelled forwardly from a pump.

2. General Background and State of the Art

Many bubble forming toys in the nature of pistols, guns and the like are known. These suffer from one or another drawbacks including the wasting of fluid and the cumbersome nature by which bubbles are formed and expelled from the toy.

This invention relates to an improved form of fluid flow in such a toy, efficiency of preserving unused bubble forming fluid, and advantageous methods for creating the bubble and expulsion of the bubble from the toy

SUMMARY OF THE INVENTION

A bubble making toy includes a propeller to cause liquid from an outlet port to spread across the space formed in a ring downstream of the propeller. The air generated by the propeller rotates under the action of a fan upstream of the propeller, and causes the ejection of air bubbles from the toy.

The bubbles are formed by liquid which is pumped from a reservoir to a dispensing port above the circumferential ring. There is a second reservoir connected to an outlet and operable by finger action to effect the ejection of fluid such as water from a second orifice from the toy.

The freely rotating propeller is mounted in the air path from the housing to the outlet for the bubbles and assists in spreading liquid across the space defined by the circumferential ring onto which liquid flows from the outlet port.

According to the invention the toy for producing bubbles comprises a housing, and a liquid dispensing port located in adjacency to a bubble forming opening located towards the forward end of the toy so that liquid for forming the bubble is dispensed from the port to a circumferentially located ring around the opening, the port, ring and opening being at or near the bubble outlet for the toy.

A reservoir for use with the housing contains the bubble liquid capable of producing the bubbles. There is a pump in the housing, the pump being connected with the reservoir by a tube to supply the liquid to the dispensing port and in turn on exiting from the port to the opening and ring.

A fan blows air in the housing through the space formed by the ring and in turn through the bubble forming liquid located across the opening of the ring.

A propeller is mounted upstream of the ring and relatively axially with the ring and is freely rotatable to facilitate the spreading of the bubble liquid across the opening Of the ring. This facilitates the location of the film across the opening. The propeller is spaced from the ring and the space and is rotatable under the action of an air stream developed in the chamber by the fan and directed to pass past the propeller and through the opening.

The propeller does not engage the circumferential ring. The liquid flows under gravity from the dispensing port which is located above the ring. The liquid outlet is located above the ring.

There is a fluid overflow port, the fluid overflow port being located below the ring and being connected to the reservoir.

The fan in the housing is rotatable and causes the generation of air through the housing to cause the blades of the propeller to rotate, the propeller blades being free running and not engaging either the ring or the housing upstream the propeller. The propeller is mounted centrally in the air path.

A fan is in the housing, and a motor operates the fan, the fan being to generate air to cause the fan to rotate and in turn create an air path to cause rotation of the propeller. The motor operates the pump, and the pump causes fluid to be pumped to the dispensing port, the dispensing port being located above the ring.

There is a switch to operate a pump, the switch being to activate a motor and in turn to activate the pump. The switch is operated by a trigger, and the toy is in the form of a toy gun, and wherein trigger activation activates closure of the switch.

In one form of the invention there is a second reservoir for water, the second reservoir being connected through a manually operable pump. This causes fluid from the secondary reservoir to be ejected from a secondary outlet, the fluid from the secondary outlet being directed in substantially the same direction as the bubbles from the bubble outlet.

The fluid in the secondary reservoir is water and the activation of the pump is through a trigger-like mechanism on a gun-like toy. The activation of the trigger causes the ejection of water from the reservoir through the secondary outlet in an effective water steam or jet. A switch for activation of the pump operates to operate the motor and in turn the pump to activate the liquid flow from the first reservoir and the rotation of the fan in the housing to create the air stream through the propeller and in turn outwardly from the device.

The invention is further described with reference to the following drawings

DETAILED DESCRIPTION OF THE INVENTION

Figure 1:
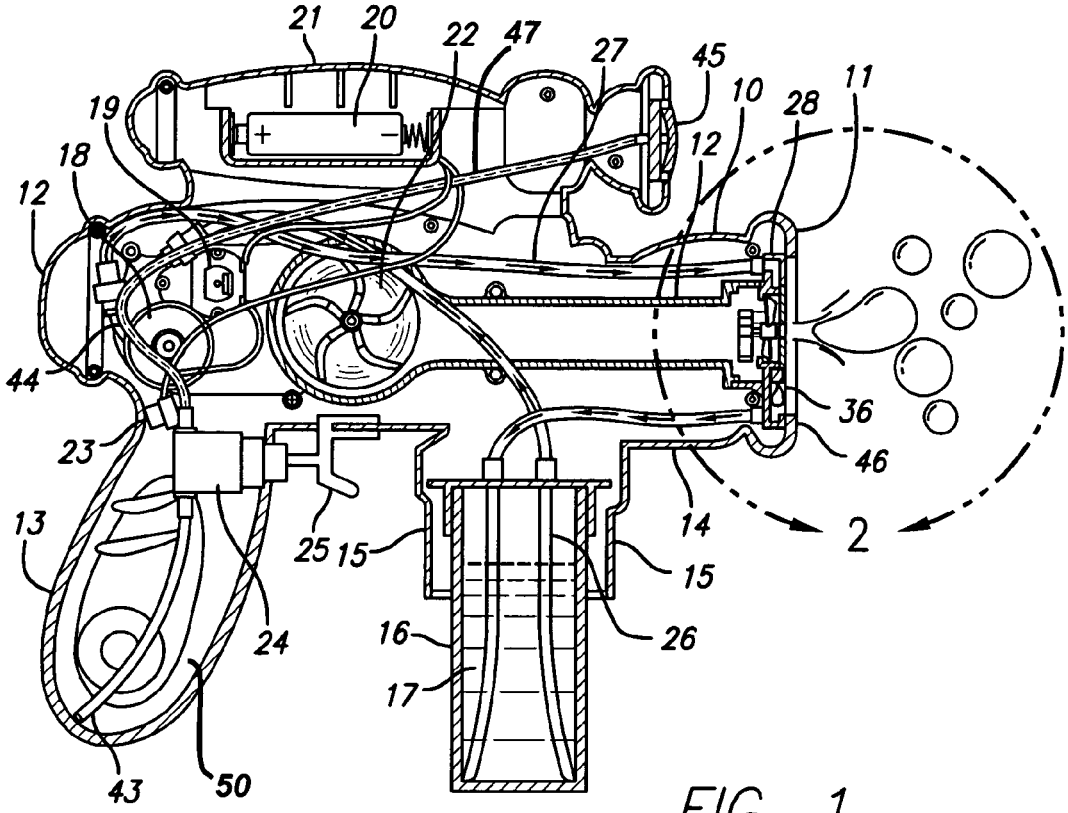
FIG. 1 is a sectional side view of a bubble forming toy in the form of a pistol.
Figure 2:
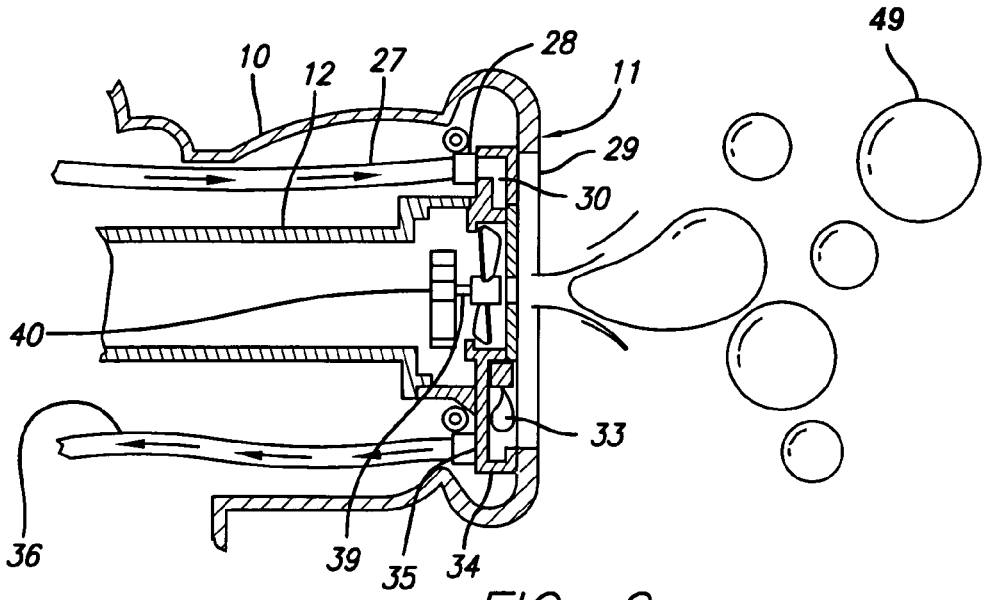
FIG. 2 is a sectional side view enlarged of the downstream and outlet portion of the bubble forming formation from the toy.
Figure 3:
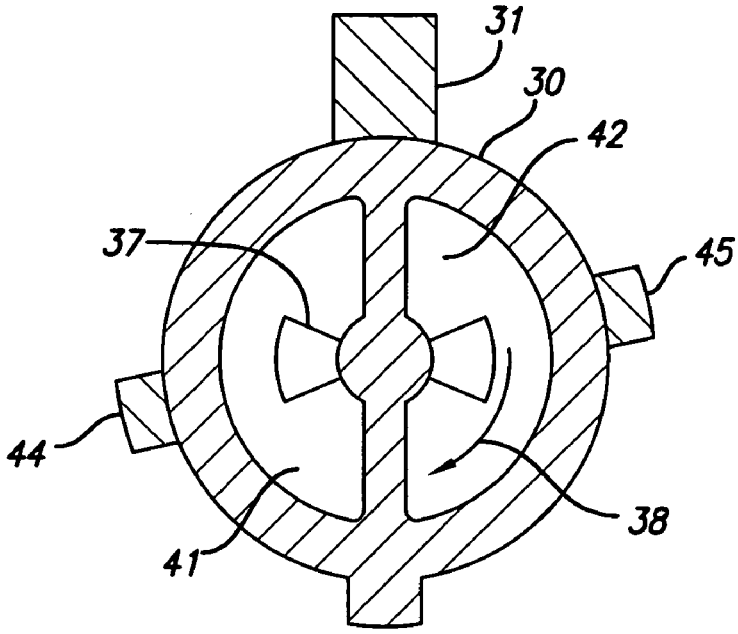
FIG. 3 is a front view of the circumferential ring located at the front of the toy.
Figure 4:
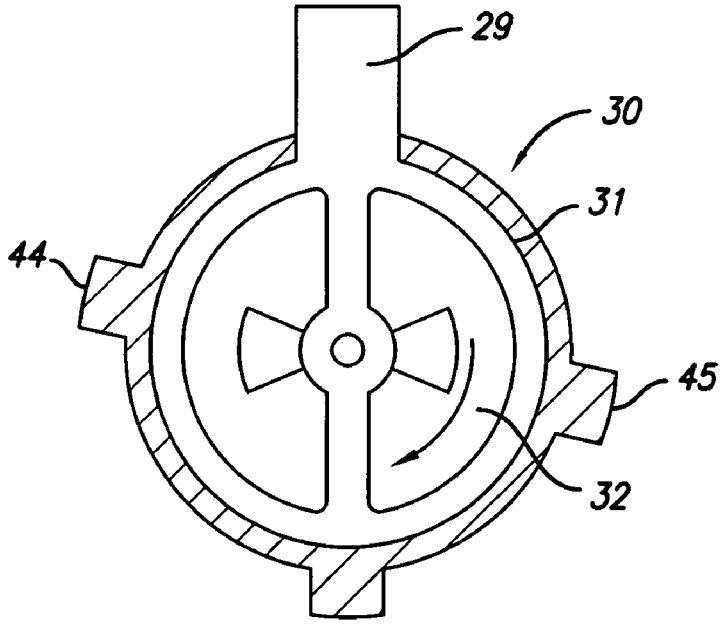
FIG. 4 is a rear view of the circumferential ring location at the front of the toy.

A bubble forming gun includes a housing with a downstream end 11 and an upstream or rear portion 12. Within the housing there is an internal chamber 12 which likewise extends from the downstream end 11 at least half way towards the upstream portion 12.

The toy housing includes a handle 13 which can be gripped by the hand of a user. Depending from the housing base portion 14 there is a cylindrical opening 15 into which can be threadingly screwed a removable reservoir 16 for holding liquid or fluid 17 for forming bubbles.

There is a pump 18 located towards the rear of the housing and pump 18 is connected with a motor 19. The motor is powered by two AA batteries 20 mounted in a superstructure housing 21 about the main housing part. The motor 19 also drives a fan 22 on to downstream the internal chamber 12. There is an on-off switch 23 which is operated directly by finger action on the outside of the housing through a mechanism extending through the housing or indirectly through the water pump 24 on activation of the pump by a trigger assembly 25 which is fingered operated by a user.

The bubble solution 17 is drawn from the reservoir 16 through the conduit 26 by the action of the pump 18. The liquid is in turn moved from the pump 18 into the tube 27 towards the outfit orifice 28. Liquid from the outfit port 28 is ejected onto the inside surface 29 of a faceplate above a circumferential ring 30. The face plate 31 is mounted on top of the circumferential ring 30. From this point the fluid falls under gravity around the circumferential ring 30 and the wall 31. The fluid forms a film on the back portion 32 of the circumferential ring as well as the upstanding wall 31.

Excess fluid 33 drops to the base 34 of this circumferential ring and in turn is drawn inwardly through a port 35 and enters the return tube 36 to be returned to the reservoir 16.

Axially spaced relative to the internal chamber 12 is a propeller 37 with two blades which can freely rotate as indicated by arrow 38 upstream of the cylindrical ring 30. The edges of the blades of the propeller do not engage the housing or the cylindrical ring where the central mounting axle 39 on a structure 40 is provided for securing the rotational axle in the chamber parent as driven from the fan 22 in the internal chamber from the upstream side to the downstream side causes the propeller to rotate freely. The rotation of the propeller causes fluid or liquid which is located on the wall 31 or 32 to spread into the aperture 41 and aperture 42. Bubbles 49 are expelled from the cylindrical surface and from the apertures 41 and 42 under the action of the air from fan 22 and any further propulsion force from the propeller 37.

The hand operating trigger 25 activates the water pump 24 which causes fluid in the nature of water to be drawn up from a second reservoir 50 through the conduit 47 and exit the conduit 44 and in turn leave through the orifice 45. In one form of the invention, the operation of the hand trigger 25 also activates the on-off switch 23 which is located behind the water pump 24 and this causes the motor 19 to switch on as necessary and the bubble bump 18 to operate. In this manner, the bubble pump can switch on and off under the action of finger trigger 25.

The construction of the present bubble toy is one where there is no applicator for physically moving against a surface. Rather, the propeller likely moves fluid across the apertures 41 and 42 to ensure that fluid does fill these apertures. The propeller is free moving on the axle 39 and is caused to rotate under the air flow created by the fan 22. The bubble fluid from the aperture 28 falls under gravity after leaving that port to the dispensing circumferential ring and the apertures 41 and 42 inside the periphery of that ring. Excess fluid is effectively trapped and efficiently returned to the fluid reservoir 16 with a minimum of wastage and also a minimum of spillage in the front. As such the front face of the toy remains relatively clean and not messy as would otherwise be caused by excess fluid.

The circumferential ring is removable from a locking base. The two side lugs 44 and 45 engage mating slots on the front face of the plate 46 bonded at the front of the housing.

Many other forms of the invention exist, each differing from others in matters of detail only. The invention is to be determined by the following claims.

I claim:

1. A toy for producing bubbles comprising:

a) a housing;

b) a liquid dispensing port located in adjacency to a bubble forming opening located towards the forward end of the toy so that liquid for forming the bubble is dispensed from the port to a circumferentially located ring around the opening, the port, ring and opening being at or near the bubble outlet for the toy;

c) a separable reservoir is connectable with the housing, the reservoir containing the bubble liquid capable of producing the bubbles;

d) a pump in the housing, the pump being connected with the reservoir by a tube to supply the liquid to the dispensing port and in turn on exiting from the port to the opening and ring;

e) a fan for blowing air in the housing through the space formed by the ring and in turn through the bubble forming liquid located across the opening of the ring; and f) a propeller mounted upstream of the ring and relatively axially of the ring and being freely rotatable to facilitate the spreading of the bubble liquid across the opening of the ring and thereby facilitate the location of the film across the opening, the propeller being spaced from the ring and the space and being rotatable under the action of an air stream developed in the chamber by the fan and directed to pass past the propeller and through the opening.

2. A toy as claimed in claim 1 wherein the liquid flows under gravity from the dispensing port which is located above the ring.

3. A toy as claimed in claim 1 wherein the liquid outlet is located above the ring.

4. A toy as claimed in claim 1 including a fluid overflow port, the fluid overflow port being located below the ring and being connected to the reservoir.

5. A toy as claimed in claim 1 wherein the fan in the housing is rotatable and causes the generation of air through the housing to cause the blades of the propeller to rotate, the propeller blades being free running and not engaging either the ring or the housing upstream the propeller.

6. A toy as claimed in claim 1 wherein the propeller is mounted centrally in the air path.

7. A toy as claimed in claim 1 including a fan in the housing, and a motor to operate the fan, the fan being to generate air to cause the fan to rotate and in turn create an air path to cause rotation of the propeller.

8. A toy as claimed in claim 1 including a motor, the motor operating the pump, and the pump causing fluid to be pumped to the dispensing port, the dispensing port being located above the ring.

9. A toy as claimed in claim 1 including a switch to operate a pump, the switch being to activate a motor and in turn to activate the pump.

10. A toy as claimed in claim 9 wherein the toy is in the form of a toy gun.

11. A toy as claimed in claim 1 including a second reservoir for water, the second reservoir being connected through a pump to cause fluid from the second reservoir to be ejected from a secondary outlet, the fluid from the secondary outlet being directed in substantially the same direction as the bubbles from the bubble outlet.

12. A toy as claimed in claim 11 wherein fluid in the second reservoir is water and the activation of the pump is through a trigger on a gun-like toy, the activation of the trigger causing the ejection of water from the reservoir through the secondary outlet in an effective water steam or jet.

13. A toy as claimed in claim 12 including activation of the pump to operate the motor and in turn the pump to activate the liquid flow from the first reservoir and the rotation of the fan in the housing to create the air stream through the propeller and in turn outwardly from the device.

* * * * *